US010821625B1

(12) United States Patent
Albers et al.

(10) Patent No.: US 10,821,625 B1
(45) Date of Patent: Nov. 3, 2020

(54) FASTENER DRIVING SYSTEM

(71) Applicants: Brent Albers, Brandon, SD (US); James Vermeer, Brandon, SD (US)

(72) Inventors: Brent Albers, Brandon, SD (US); James Vermeer, Brandon, SD (US)

(73) Assignee: Albers VerMeer Design, LLC, Brandon, SD (US)

( * ) Notice: Subject to any disclaimer, the term of this patent is extended or adjusted under 35 U.S.C. 154(b) by 98 days.

(21) Appl. No.: 15/971,344

(22) Filed: May 4, 2018

(51) Int. Cl.
*B27F 7/11* (2006.01)
*B27F 7/13* (2006.01)

(52) U.S. Cl.
CPC . *B27F 7/11* (2013.01); *B27F 7/13* (2013.01)

(58) Field of Classification Search
CPC ..... B27F 7/02; B27F 7/11; B27F 7/13
USPC ..... 227/100, 120, 155
See application file for complete search history.

(56) References Cited

U.S. PATENT DOCUMENTS 3,924,692 A 12/1975 Saari
3,945,549 A * 3/1976 Colson ..... B27F 7/02 227/45
4,082,152 A 4/1978 Whitworth
4,318,446 A 3/1982 Livesay
4,782,989 A * 11/1988 Wallin ..... B27F 7/02 227/110
5,002,134 A 3/1991 Yamada
5,379,513 A * 1/1995 Thompson ..... B27F 7/006 227/45
6,250,401 B1 6/2001 Yamada
8,127,974 B2 3/2012 Zhang
8,256,527 B2 9/2012 Wu
8,297,373 B2 10/2012 Elger
8,875,969 B2 11/2014 Pedicini
2003/0192933 A1 10/2003 Pedicini
2004/0232194 A1 11/2004 Pedicini
2008/0190988 A1 8/2008 Pedicini
2010/0213236 A1 8/2010 Zhang

FOREIGN PATENT DOCUMENTS

WO 2010124036 10/2010

* cited by examiner

*Primary Examiner* — Nathaniel C Chukwurah
(74) *Attorney, Agent, or Firm* — Jeffrey A. Proehl; Woods, Fuller, Shultz & Smith, PC

(57) ABSTRACT

A system for moving a fastener into a sheet material and support structure may include a main support frame, and a fastener movement apparatus having a guide frame defining a channel, and a contact member having a contact tip for contacting the head of a fastener in a driving position. The apparatus may include a guide tube configured to hold a fastener, a primary movement assembly configured to transmit an impulse to a fastener head of the fastener through the contact member, and a secondary movement assembly configured to move the primary movement assembly. The system may also include a control assembly configured to control the primary movement assembly and secondary movement assembly of the at least one fastener movement apparatus.

15 Claims, 11 Drawing Sheets

FASTENER DRIVING SYSTEM

BACKGROUND

Field

The present disclosure relates to fastener driving apparatus and more particularly pertains to a new fastener driving system for driving fasteners into relatively fragile work pieces in a consistent manner with a reduced chance for damage.

SUMMARY

In one aspect, the present disclosure relates to a system for moving at least one fastener along a movement axis into a sheet material and into a support structure resting on a support bed to fasten the sheet material to the support structure, with the sheet material having a face defining a face plane. The system may comprise a main support frame with at least a portion of the main support frame extending over the support bed, and at least one fastener movement apparatus movably mounted on the main support frame. The at least one fastener movement apparatus may comprise a guide frame defining a channel extending along the movement axis, and a contact member movable with respect to the guide frame along the movement axis, with the contact member being at least partially positioned in the channel of the guide frame and having a contact tip for contacting the head of a fastener in a driving position. The at least one fastener movement apparatus may also comprise a guide tube configured to hold a fastener to be moved and extending along the movement axis, with the guide tube having a passage for receiving the fastener. The at least one fastener movement apparatus may further comprise a primary movement assembly configured to transmit an impulse to a head of the fastener through the contact member, and a secondary movement assembly configured to move the primary movement assembly in a direction substantially parallel to the movement axis. The system may also include a control assembly configured to control the primary movement assembly and secondary movement assembly of the at least one fastener movement apparatus.

in another aspect, the disclosure relates to a system for moving at least one fastener along a movement axis into a sheet material and into a support structure resting on a support bed to fasten the sheet material to the support structure, with the sheet material having a face defining a face plane and the sheet material moving relative to the system in a first longitudinal movement direction. The system may comprise a main support frame with at least a portion of the main support frame extending over the support bed, and a plurality of fastener movement apparatus movably mounted on the main support frame. The plurality of fastener movement apparatus may be arranged in at least one array, with a first said array being positioned substantially along a line extending in a second lateral movement direction transverse to the first longitudinal movement direction. A fastener movement apparatus may comprise a guide frame defining a channel extending along the movement axis, and a contact member movable with respect to the guide frame along the movement axis, with the contact member being at least partially positioned in the channel of the guide frame and having a contact tip for contacting the head of a fastener in a driving position. A fastener movement apparatus may also comprise a guide tube configured to hold a fastener to be moved and extending along the movement axis, with the guide tube having a passage for receiving the fastener. A fastener movement apparatus may further comprise a primary movement assembly configured to transmit an impulse to a head of the fastener through the contact member, and a secondary movement assembly configured to move the primary movement assembly in a direction substantially parallel to the movement axis. The system may also comprise a control assembly configured to control the primary movement assembly and secondary movement assembly of the at least one fastener movement apparatus.

There has thus been outlined, rather broadly, some of the more important elements of the disclosure in order that the detailed description thereof that follows may be better understood, and in order that the present contribution to the art may be better appreciated. There are additional elements of the disclosure that will be described hereinafter and which will form the subject matter of the claims appended hereto.

In this respect, before explaining at least one embodiment or implementation in greater detail, it is to be understood that the scope of the disclosure is not limited in its application to the details of construction and to the arrangements of the components. and the particulars of the steps, set forth in the following description or illustrated in the drawings. The disclosure is capable of other embodiments and implementations and is thus capable of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present disclosure. It is important, therefore, that the claims be regarded as including such equivalent constructions insofar as they do not depart from the spirit and scope of the present disclosure.

The advantages of the various embodiments of the present disclosure, along with the various features of novelty that characterize the disclosure, are disclosed in the following descriptive matter and accompanying drawings.

BRIEF DESCRIPTION OF THE DRAWINGS

The disclosure will be better understood and when consideration is given to the drawings and the detailed description which follows. Such description makes reference to the annexed drawings wherein.

DETAILED DESCRIPTION

Figure 1:
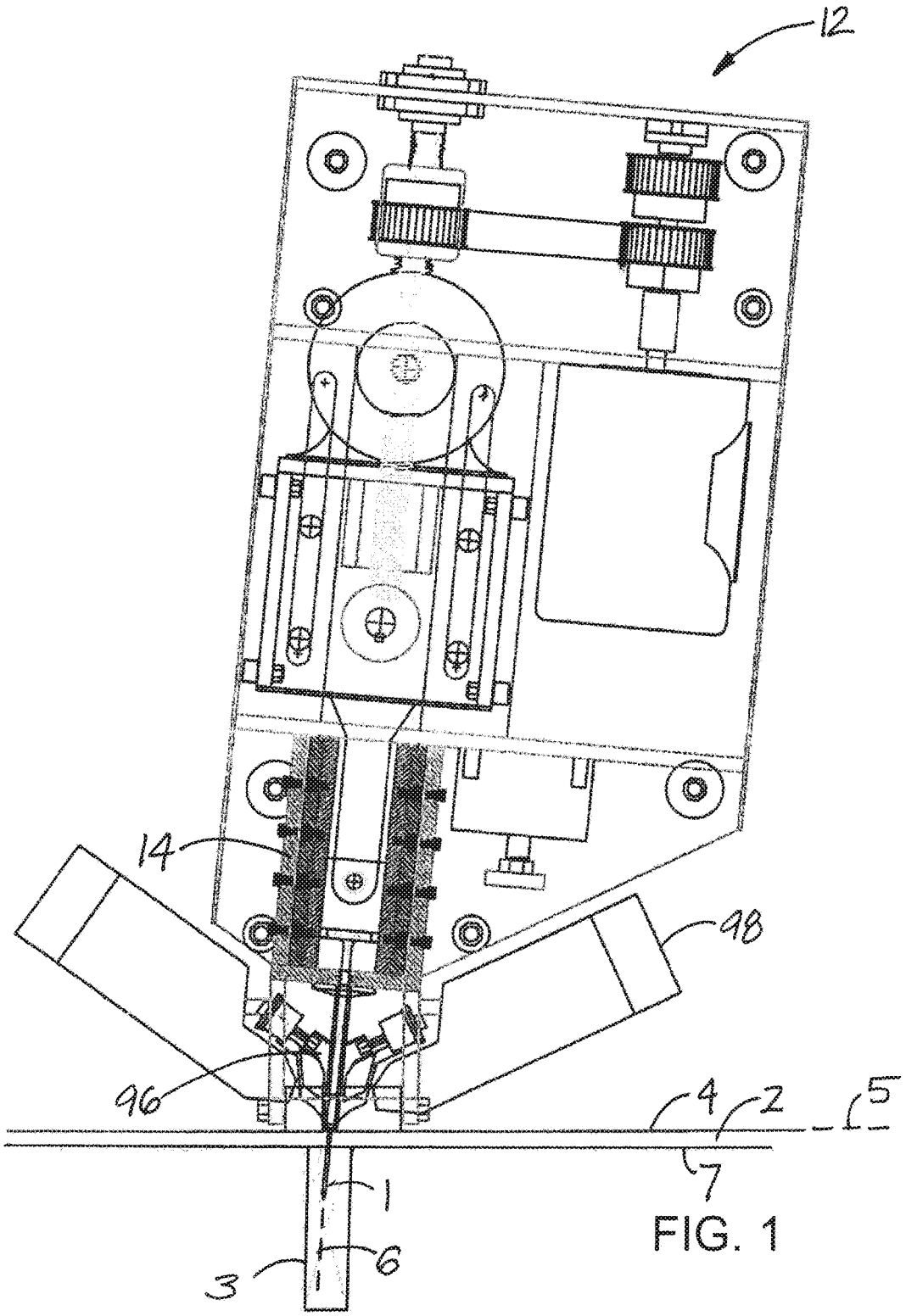
FIG. 1 is a schematic side view of a fastener movement apparatus of a new fastener driving system according to the present disclosure.
Figure 2:
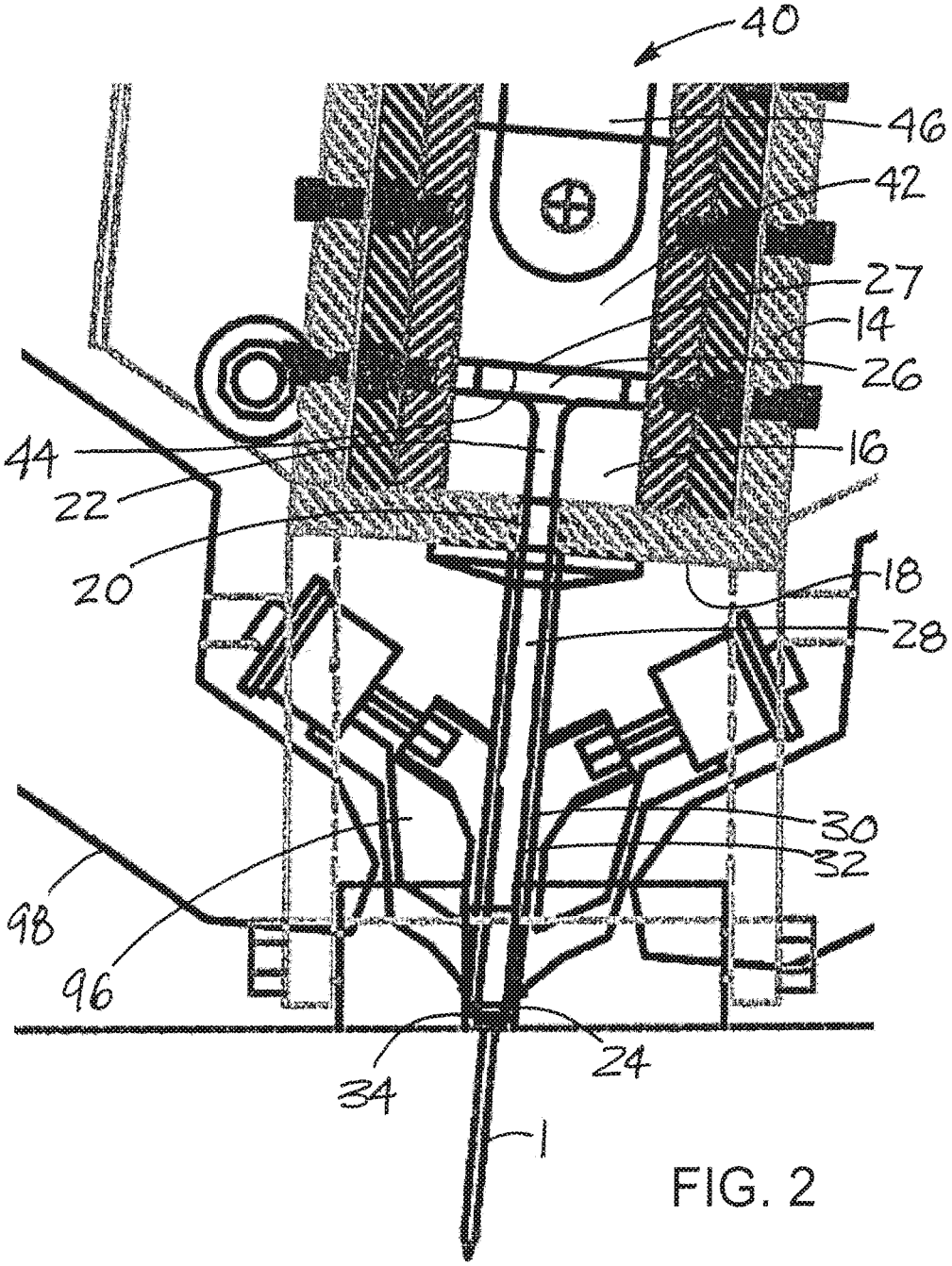
FIG. 2 is a schematic enlarged side view of a portion of the fastener movement apparatus shown in FIG. 1, according to an illustrative embodiment.
Figure 3:
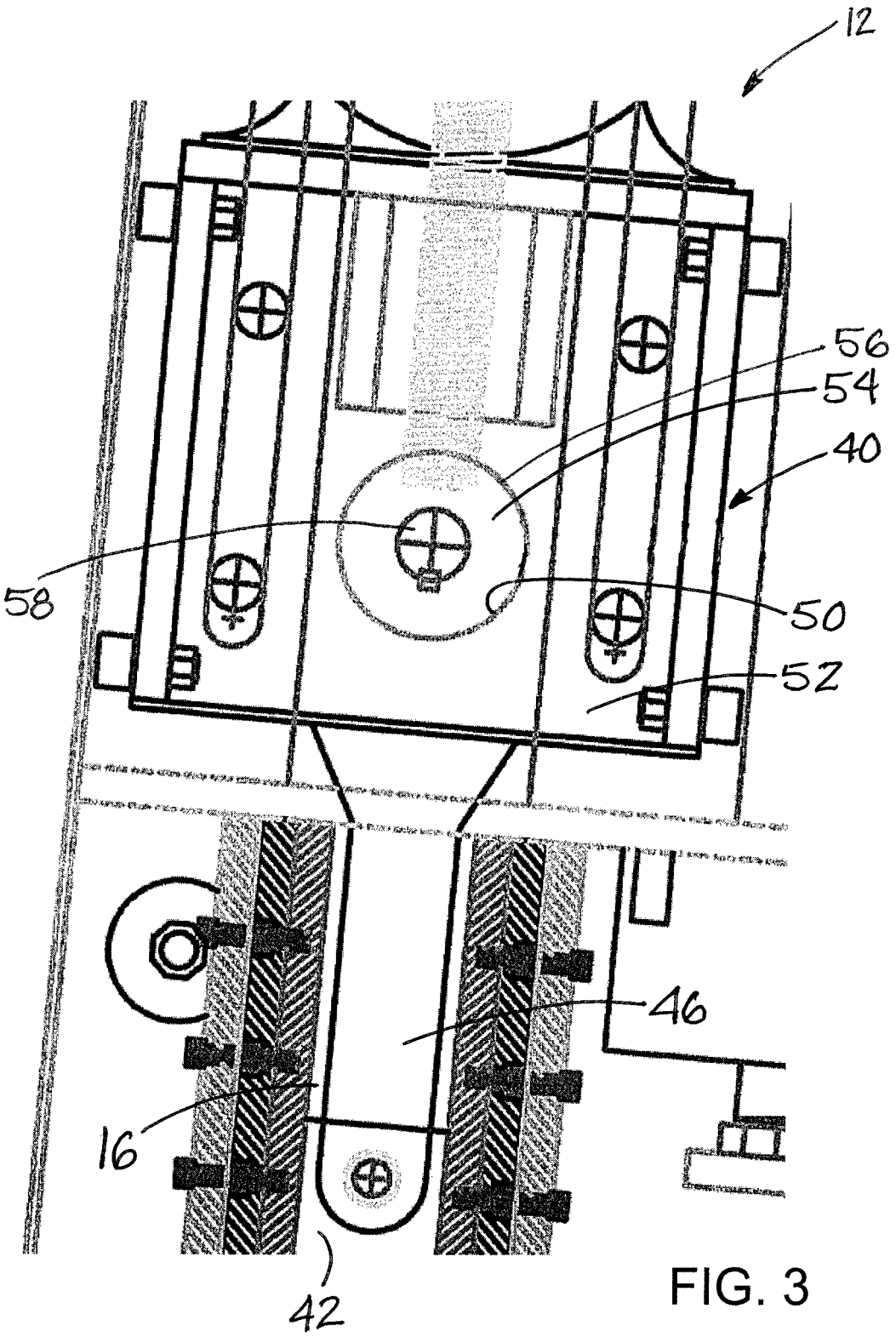
FIG. 3 is a schematic enlarged side view of a portion of the fastener movement apparatus shown in FIG. 1, according to an illustrative embodiment.
Figure 4B:
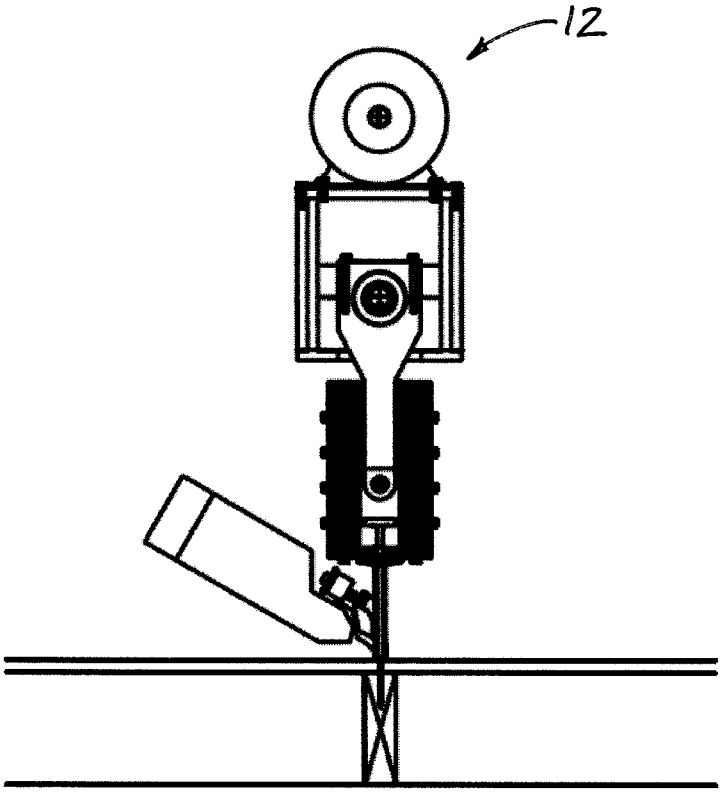
FIG. 4B is a schematic side view of selected elements of the fastener movement apparatus with the secondary movement assembly located toward a final movement position, according to an illustrative embodiment.
Figure 4A:
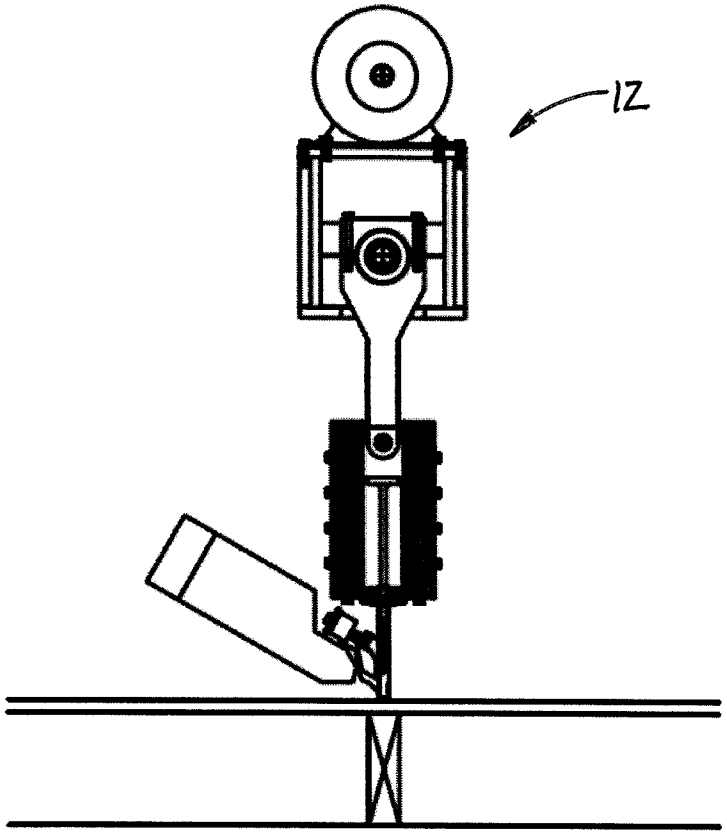
FIG. 4A is a schematic side view of selected elements of the fastener movement apparatus with the secondary movement assembly located toward an initial movement position, according to an illustrative embodiment.
Figure 5:
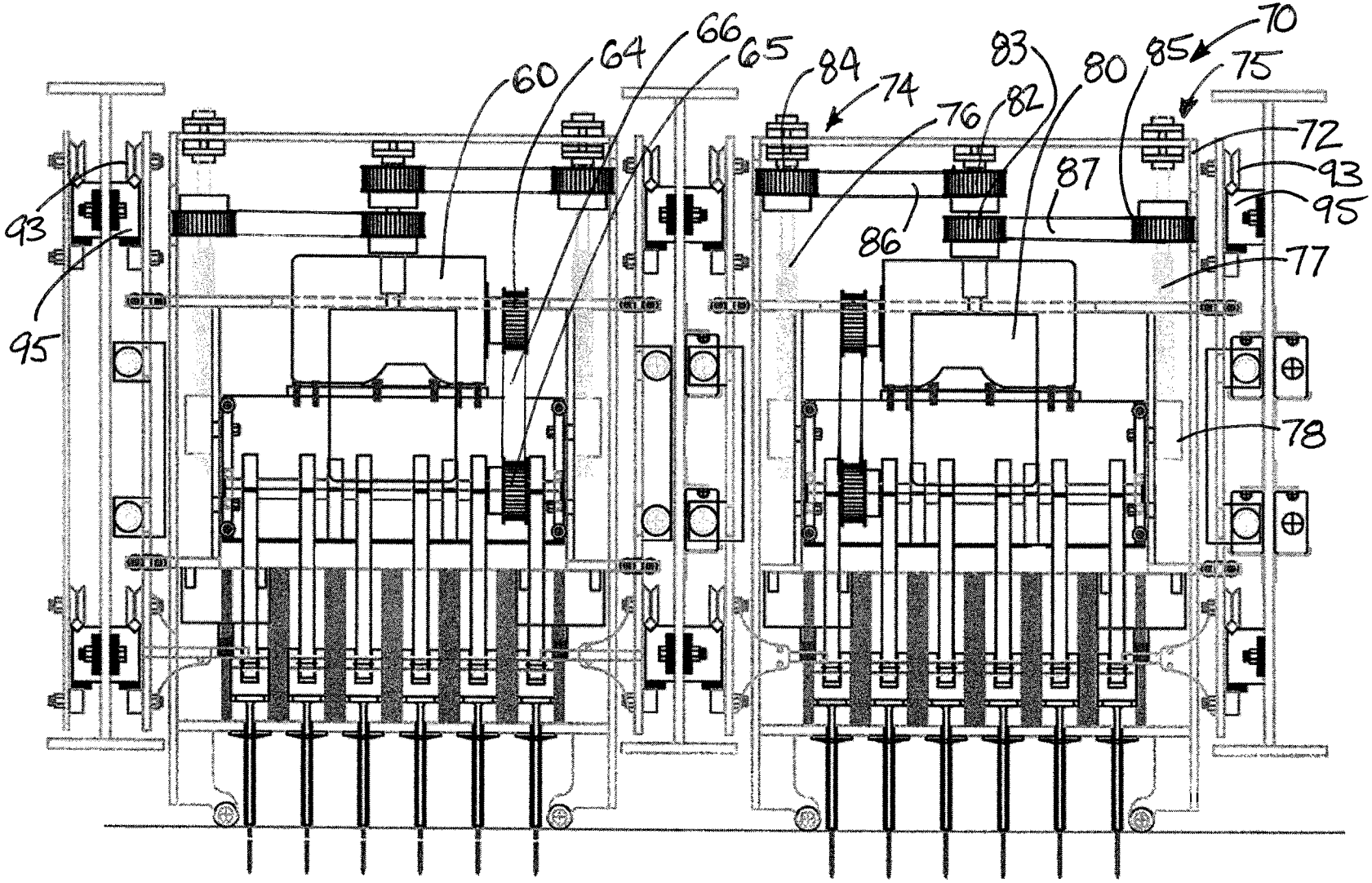
FIG. 5 is a schematic side view of a plurality of the fastener movement apparatus in arrays, according to an illustrative embodiment.
Figure 6:
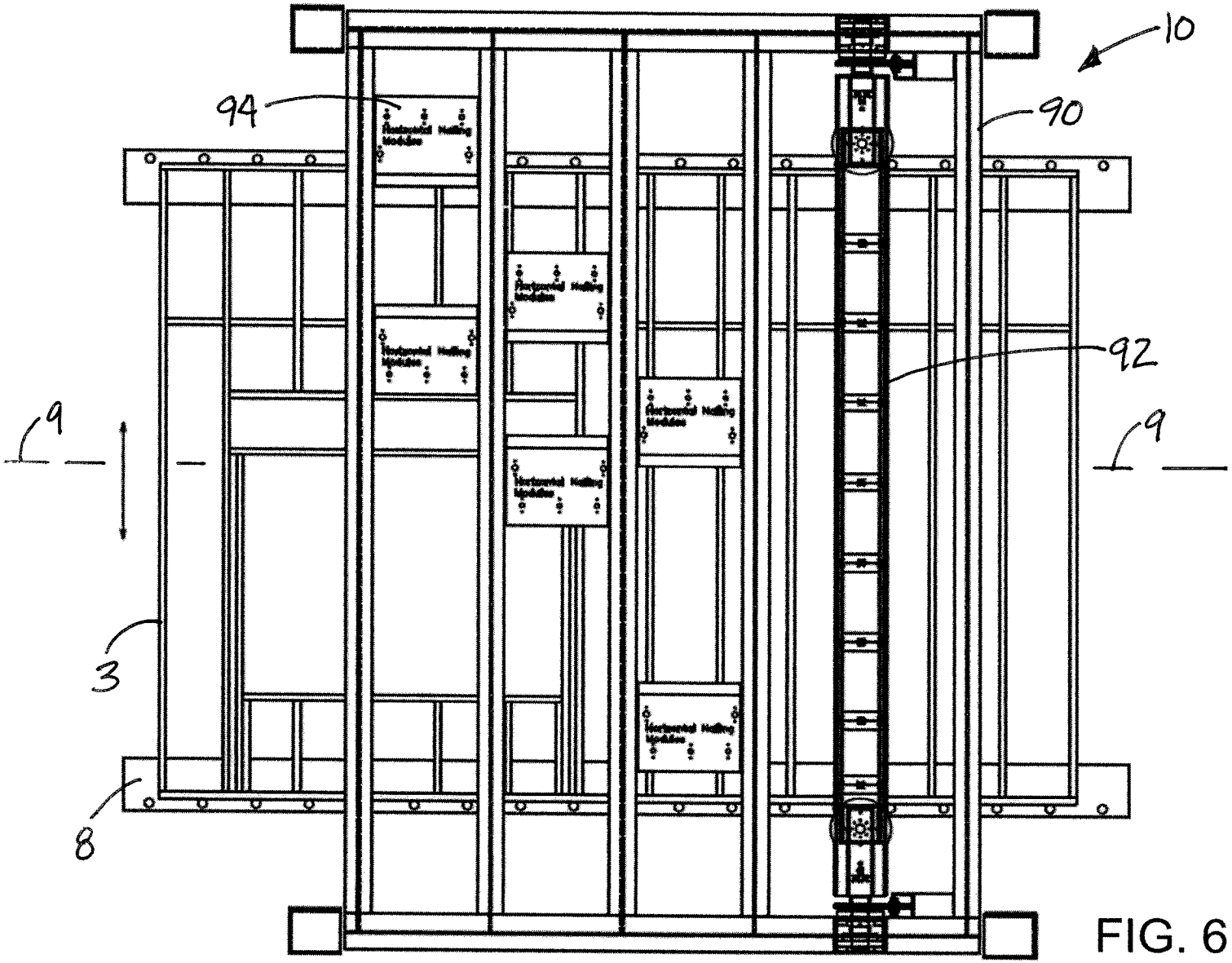
FIG. 6 is a schematic top view of the fastener driving system, according to an illustrative embodiment, showing a plurality of fastener movement apparatus in various positions on the main support frame.
Figure 7:
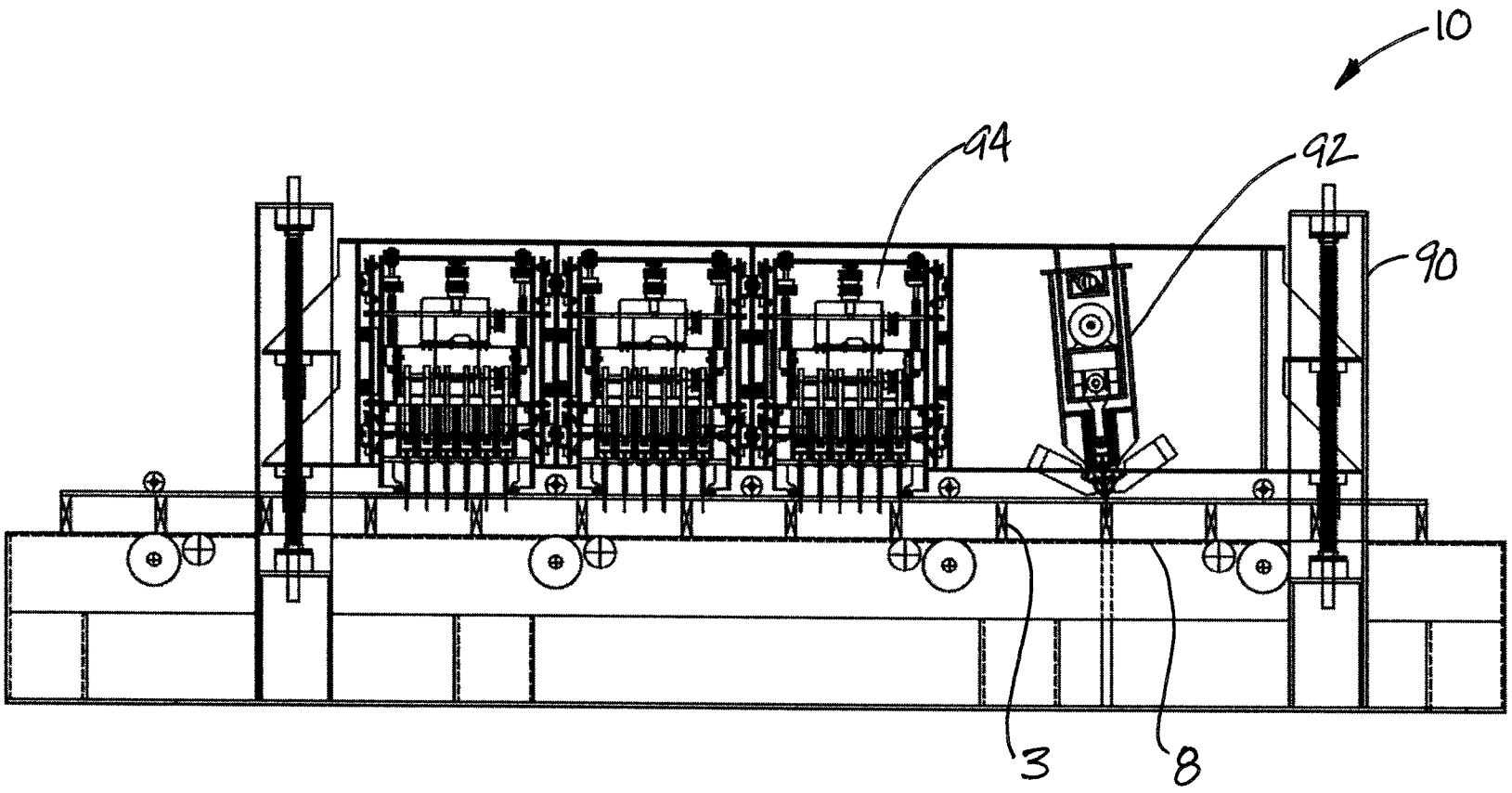
FIG. 7 is a schematic side elevation view of the fastener driving system looking in a direction transverse to the longitudinal movement direction, according to an illustrative embodiment.
Figure 8:
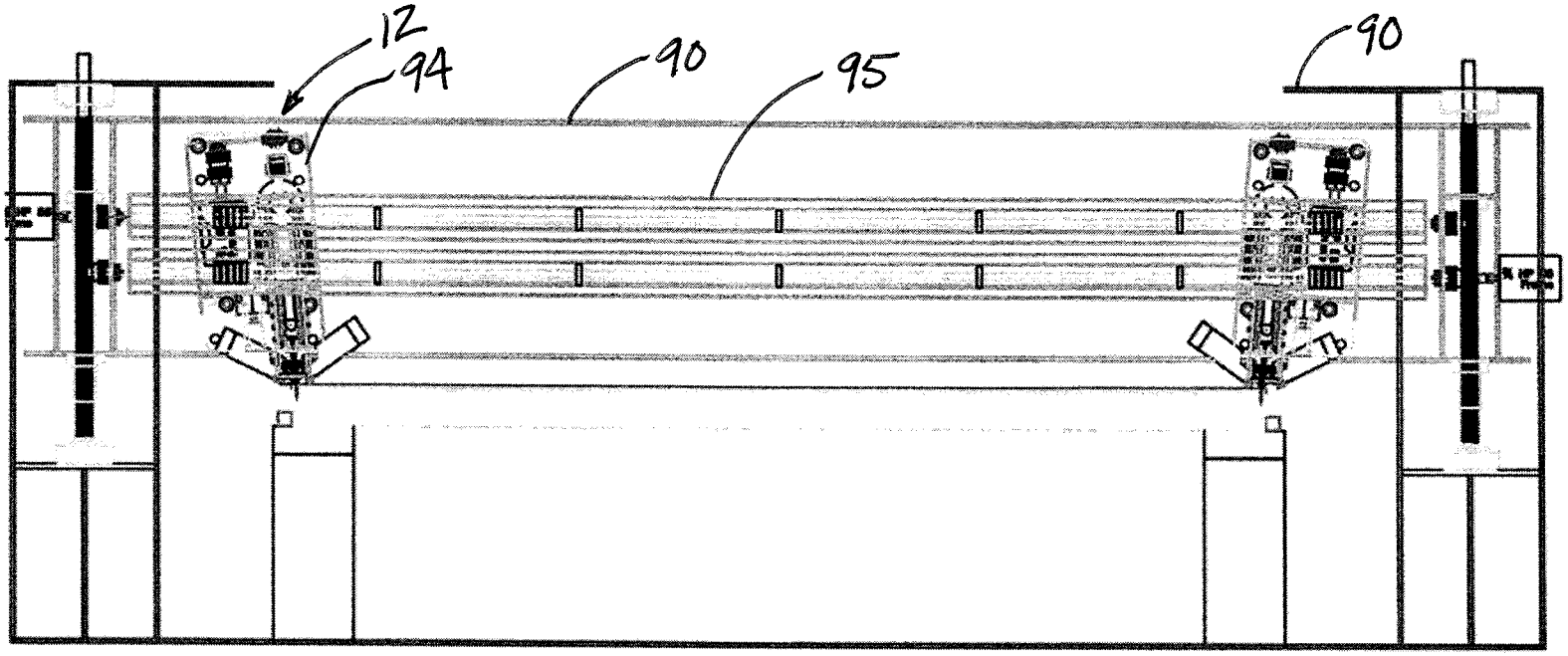
FIG. 8 is a schematic front elevation view of the fastener driving system looking in the longitudinal movement direction, according to an illustrative embodiment.
Figure 9:
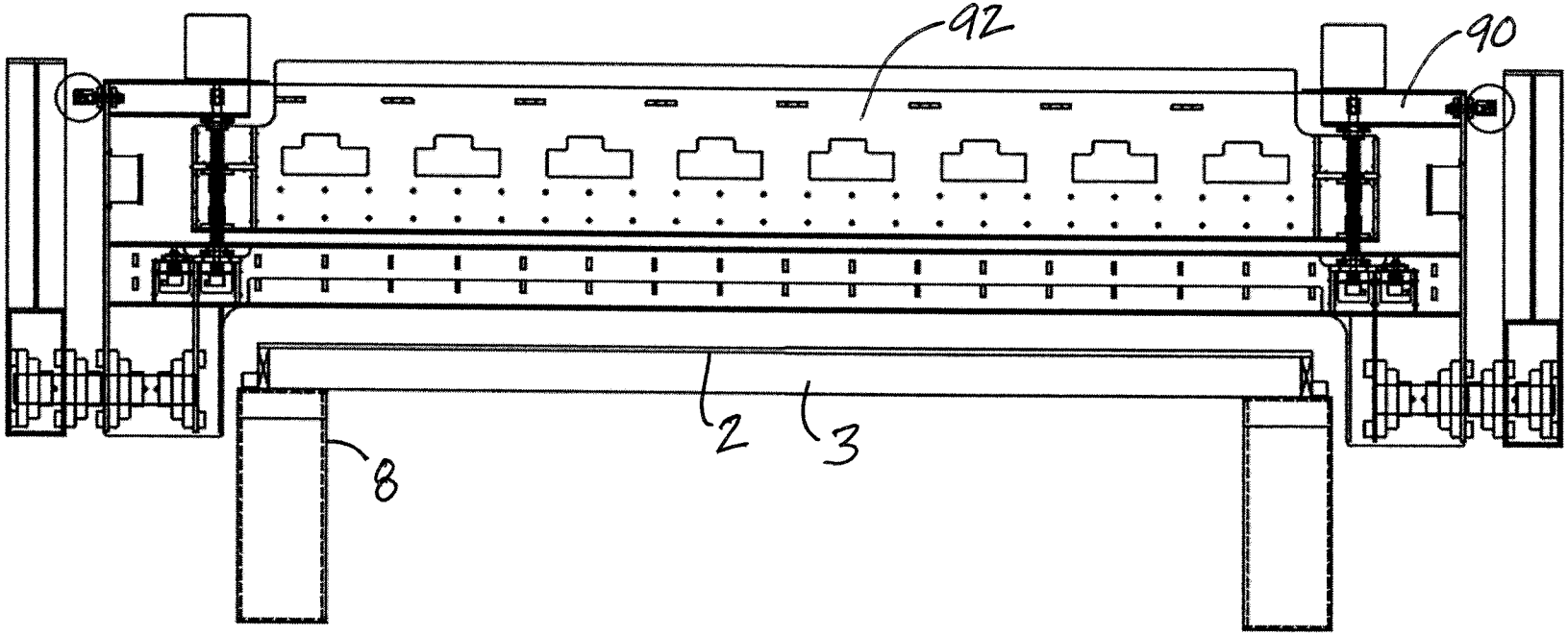
FIG. 9 is a schematic rear elevation view of the fastener driving system looking opposite of the longitudinal movement direction, according to an illustrative embodiment.

With reference now to the drawings, and in particular to FIGS. 1 through 11 thereof, a new fastener driving system embodying the principles and concepts of the disclosed subject matter will be described.

Applicants have recognized problems arise when nails are attempted to be driven through gypsum board into a supporting frame structure (usually including wood boards) using known automated nailing apparatus. Gypsum board includes thick paper on both broad faces for protecting the interior gypsum (e.g., from moisture) and providing a substantial degree of the strength of the gypsum board. However, the paper is vulnerable to being torn or punctured if a nail is driven too hard or too far into the gypsum board, and the integrity of the board may thus be compromised. Driving nails through the gypsum board without damaging the paper is difficult, not necessarily due to inconsistencies in the gypsum board but instead due to inconsistencies in the framing boards to which the gypsum board is being nailed. Varying densities of the wood forming the frame, being a natural material, as well as flaws in the surface of the boards and variations in the linearity of the boards that create gaps between the gypsum board surface and the wood, and other conditions affect the driving of the nail into the gypsum board and often lead to tearing of the paper. A further complication arises when a layer of insulation (such as a foamed insulation) is interposed between the gypsum board and the frame structure and the nailing apparatus must drive nails into three different materials with accompanying variations. Known nail driving machinery utilize a single impact on the fastener with sufficient force to drive the fastener the entire distance into the work piece, which the applicants have recognized greatly reduces the precision to which the fastener can be driven into the work piece when the aforementioned variables come into play.

The applicants have developed a fastener driving system that moves or advances the fastener (e.g., a nail) into the desired position with greater precision than known nailing driving apparatus. The apparatus utilizes two types of movement to drive the fastener into position. The first type of movement is an impulse movement or impact of the same broad character as when a hammer strikes a nail to drive it into a material. However, the impulse movement utilized is much smaller in distance or stroke than the typical impact of conventional nail driving machinery, which usually utilizes a single impact with sufficient force to drive the fastener the entire distance. Instead, the impulse movement is repeated multiple times on the same fastener such that the movement of the fastener achieved by a single impact is small in magnitude. As a result, the force applied to the fastener in each impact may be significantly reduced since a single impact does not need to drive the fastener the entire distance into the work piece, but only a small portion of the entire distance that the fastener needs to be driven. Illustratively, a rotating cam with a relatively small lobe eccentricity may be used to create the impact to the head of the fastener to drive the fastener in the very small increments utilized in the apparatus.

The other type of movement involves the progressive movement of the apparatus creating the impacts with the fastener and toward the work piece as the fastener moves incrementally into the work piece. Illustratively, the cam and impact elements are moved progressively closer to the work piece. By this apparatus, the typical single driving impact used in nail driving machinery is avoided, and instead multiple smaller impacts are utilized in succession for driving the fastener the same distance.

In one aspect, the disclosure relates to a system 10 for driving or moving at least one fastener 1 into a panel of sheet material 2 and into a support structure 3 to fasten the sheet material to the support structure (the sheet material and support structure may be referred to as the "work piece"). The sheet material 2 may have broad faces, including a front face 4 and a rear face 7 positioned opposite of the front face 4. The front face may be generally oriented away from the support structure 3 and the rear face may be generally oriented towards the support structure 3. The rear face 7 may be positioned adjacent to the support structure 3 and may be abutted against or rested on support structure 3, although in some embodiments an intervening structure or layer of material may be interposed, such as a layer of insulation. The front face 4 of the panel of sheet material may define a face plane 5.

The fastener 1 may be advanced along a movement axis 6 which is typically oriented substantially perpendicular to the face plane 5 but may vary in orientation somewhat from perpendicular. In some embodiments of the system 10, the support structure may be supported on a support bed 8. In some embodiments, the sheet material and support structure on the support bed may remain relatively stationary while other fastener driving elements of the system 10 move, although other implementations may utilize active movement of the work piece (e.g., the sheet material 2 and support structure 3). Movement of the work pieces into and out of the system 10 may occur in a first longitudinal movement direction 9.

The sheet material 2 may comprise a rigid panel of sheet material, such as a wall board or panel, formed of various types of materials. For the purposes of this description of the system 10, the wall board or panel comprises a gypsum wall board with a layer of fibrous material forming each of the faces 4, 7 and with an intermediate layer to which the paper of the faces is adhered or otherwise bonded. In many embodiments, the fibrous layers comprise a paper (usually a thick paper) and the intermediate layer comprises a cementitious material such as gypsum. The cementitious gypsum material is typically rigid with only minimal flexibility, and may exhibit a significant degree of brittleness, and the paper layers at the faces function to provide a degree of resistance to breaking or cracking of the gypsum. When the paper layer is removed or damaged, the integrity and resistance to breakage may be compromised. The support structure 3 may comprise a frame formed of members or boards which includes a perimeter as well as one or more intermediate cross members extending across the perimeter to provide rigidity to the perimeter as well as provide support for the panel or panels of sheet material. The support structure may include a plurality of the intermediate cross members, such as the wall studs typically found in a structural wall forming a plurality of wall bays, but may also include larger voids for forming window and door openings in a wall incorporating the assembly of the sheet material and support structure structure formed by the system 10. The members of the support structure may comprise boards formed of any suitable material, but typically are formed of wood. The type of wood utilized may vary, and different woods may have differing densities requiring relatively greater or lesser degrees of force to drive fasteners into the board.

The system 10 may comprise at least one fastener movement apparatus 12 for moving a fastener 1 into the sheet material and into the support structure in a manner that fastens the sheet material to the support structure through the use of one or more of the fasteners. Each fastener movement apparatus 12 may include a guide frame 14 to provide guidance for elements of the system that move the fastener into the sheet material 2. The guide frame 14 may define a channel 16 which may extend along and substantially parallel to a portion of the movement axis 6 of the fastener to be driven. The guide frame 14 may remain substantially stationary with respect to the face plane 5 in the direction of the movement axis 6, and the guide frame 14 may be movable in a direction that is substantially parallel to the face plane 5 to position the apparatus adjacent to various locations on the sheet material where fasteners need to be driven. The guide frame 14 may have an outer end 18 positioned relatively closer to the face plane 5, and an aperture 20 may be formed on the outer end 18 of the guide frame that is in communication with the channel 16. In some embodiments, a maximum width of the aperture 20 may be smaller than a maximum width of the channel 16.

The fastener movement apparatus 12 may also include a contact member 22 which may be movable with respect to the guide frame 14, and the contact member may be movable along, or parallel to, the movement axis 6 of the fastener. The contact member 22 may be at least partially positioned in the channel 16 of the guide frame 14, and a portion of the contact member may extend through the aperture 20 of the guide frame for contacting a fastener 1. The contact member 22 may have a contact tip 24 located outside of the channel 16 for contacting the head of a fastener 1 located in a driving position, and the tip 24 may be positioned outside of the channel 16. Illustratively, the contact member 22 may comprise a contact flange 26 with a contact surface 27, both of which may be located in the channel 16 of the guide frame 14. The contact member 22 may also include a contact shaft 28 that extends from the contact flange 26 and may terminate at the contact tip 24. The contact shaft 28 may extend through the aperture 20 such that a portion of the contact shaft 28 is positioned in the channel 16 and a portion of the contact shaft (including the contact tip) is positioned outside of the channel for abutting against a fastener, or a structure abutting against the fastener.

The fastener movement apparatus 12 may also include a guide tube 30 which may be configured to hold a fastener 1 to be moved by the apparatus 12 into the sheet material 2 and support structure 3. The guide tube 30 may extend along the movement axis 6, and may be substantially centered on the axis 6. The guide tube 30 may have a passage 32 for receiving a fastener to be moved by the apparatus into the sheet material. The passage 32 may have an end portion 34 which may define the driving position for the fastener.

The system 10 may also include a primary movement assembly 40 which is configured to transmit an impulse or impulsive force to the fastener 1 in the driving position. The primary movement assembly 40 may include an impact member 42 which is configured to transmit an impulsive force to the contact member 22 and may impact the contact member 22. In some implementations, separation is created between the impact member 42 and the contact member 22 to create a gap which results in an impact being transmitted to the contact member to create an impulsive force when the elements come back into contact with each other. The impact member may be at least partially positioned in the channel 16 of the guide frame 14, and may be movable with respect to the guide frame. An impact surface 44 of the impact member 42 may be configured to abut against the contact surface 27 on the contact flange of the contact member.

The primary movement assembly 40 may also include a connector member 46 which may be connected to the impact member 42 and may also be at least partially positioned in the channel 16 of the guide frame. A cavity 48 may be formed in the connector member 46 and the cavity may be formed by a cavity edge 50. The cavity edge 50 may define a substantially circular perimeter for the cavity 48.

The primary movement assembly 40 may also include a primary frame 52 which may be movable with respect to the guide frame 14, and may be located above the guide frame. The primary movement assembly 40 may also include a cam member 54 which may be configured to act on the connector member 46 (as a follower of the cam member) to move the connector member 46 in a reciprocating manner. The cam member 54 may be positioned in the cavity 50 of the connector member and may rotate with respect to the connector member. The connector member 46 may have an eccentric perimeter edge 56 which may define a lobe. The lobe may protrude from the center of rotation of the cam member a distance of approximately 0.045 inches to approximately 0.05 inches more than the remainder portion of the perimeter edge 56 extends from the center. In one illustrative embodiment, the protrusion of the lobe from the center of rotation of the cam member has a distance of approximately 0.045 inches.

Figure 10:
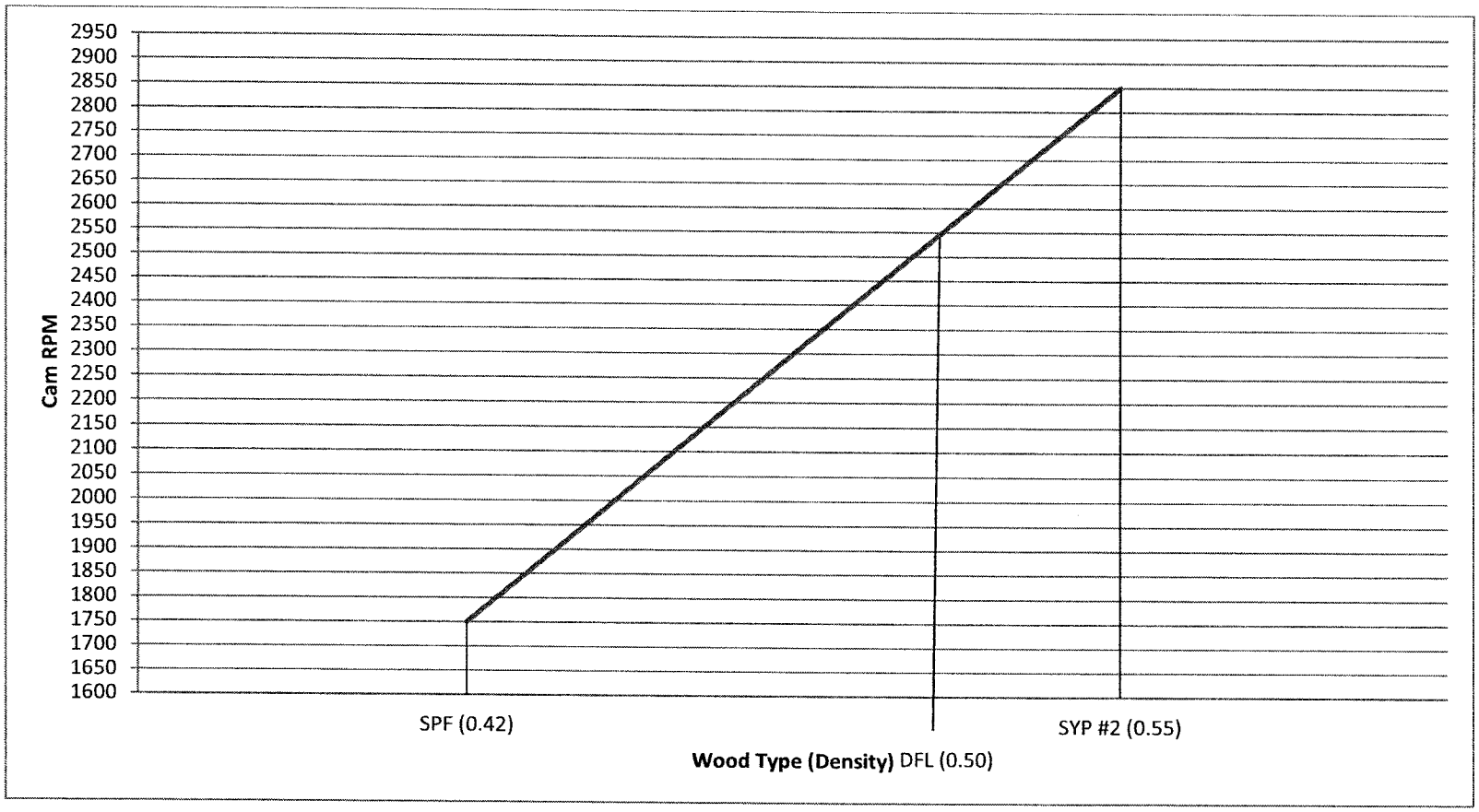
FIG. 10 is a schematic graph of one relationship between the rotational speed of the cam member (and the corresponding impacts per minute) and the relative density of the wood forming the support structure, according to an illustrative implementation.
Figure 11:
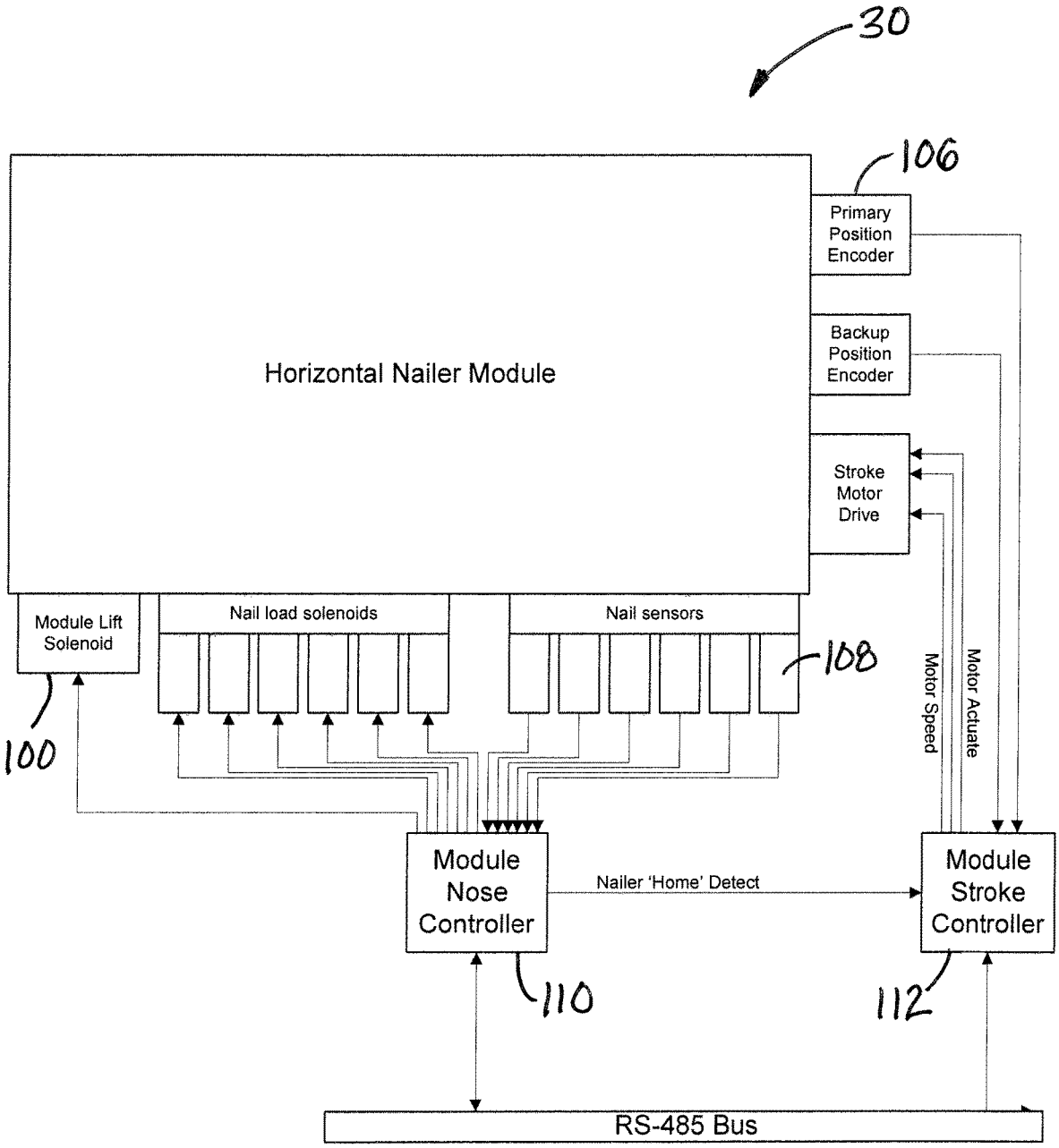
FIG. 11 is a schematic diagram of an embodiment of a control assembly of the fastener driving system, according to an illustrative embodiment.

The primary movement assembly 40 may also include a shaft 58 on which the cam member 54 is mounted such that rotation of the shaft 58 rotates the cam member with respect to the connector member 46. The shaft 58 may be rotatably mounted on the primary frame 52. A motor 60 of the primary movement assembly 40 may be connected to the shaft to rotate the shaft 58 through a primary movement transfer structure 62 that transfers rotational motion from the motor 60 to the shaft 58. In the illustrative embodiment, the primary movement transfer structure 62 comprises a driver pulley 64 mounted on the output shaft of the motor and a driven pulley 65 mounted on the shaft 58, with a belt 66 or chain being entrained on the pulley 64, 65 to transmit the rotational motion therebetween. The rotational speed of the motor, and thus the number of impacts delivered to the fastener in a given period of time by the primary movement assembly, may be varied and may be adjusted according to various factors, such as, for example, the characteristics of the sheet material and/or the support structure. Illustratively, the rotational speed and rate of impacts may be varied according to the relative density of the wood used for the supporting structure. FIG. 10 shows an illustrative relationship between increasing wood species density and the rotational speed of the shaft and cam member, with the speed of rotation and impacts per unit time generally increasing with the increased density of the wood species.

The system may include a secondary movement assembly 70 which may be configured to move the primary movement assembly 40 generally toward the work piece (e.g., the sheet material and support structure) and may move the assembly 40 in a direction that is substantially parallel to the movement axis 6 of the fastener. The movement of the primary movement assembly by the secondary movement assembly between an initial movement position (see FIG. 4A) and a terminal or final movement position (see FIG. 4B) may generally correspond to the movement of the fastener into the work piece, and the distance moved by the primary movement assembly by the secondary movement assembly may generally correspond to the distance that the fastener is driven into the work piece. The movement of the primary assembly 40 by the secondary assembly 70 may occur simultaneously with the (e.g., impulse) movement of the contact member 22 by the primary assembly, and the action of the secondary assembly 70 may permit the contact member and the primary assembly 40 to follow the fastener as the multiple impacts on the fastener by the primary assembly drive the fastener further into the work piece. The relatively larger movement of the primary assembly by the secondary assembly permits the implementation of relatively smaller impulsive movements by the primary assembly to engage the fastener.

In some embodiments, a single secondary movement assembly may be configured to move one primary movement assembly, or may move a plurality of the primary movement assemblies at the same time, for example, as a unit. In some implementations the secondary movement assembly 70 may be configured to advance the primary movement assembly in a substantially continuous movement uniform, while in some implementations the secondary movement assembly may be configured to move the primary movement assembly in discrete movements or steps which may be separated by pauses in the movement of the primary movement assembly, and each of the step movements may occur over a substantially uniform movement distance such that the primary movement assembly is advanced substantially equal distances at each step. The rate of movement of the primary movement assembly by the secondary movement assembly may vary, and may vary according to the actual movement of the fastener into the work piece. Illustratively, the rate of movement of the primary assembly 40 by the secondary assembly 70 may be approximately 2 inches per second to approximately 3 inches per second. The distance of movement of the primary assembly by the secondary assembly may be approximately 5 inches to approximately 5⅝ inches.

The secondary movement assembly 70 may include a secondary frame 72 on which the primary movement assembly 40 is mounted. The secondary movement assembly may also include at least one actuator 74 mounted on the secondary frame 72 and engaging the primary frame 52. In some embodiments, a pair of actuators 74, 75 may be employed with the actuators being located on opposite sides or ends of an array of the primary movement assemblies 40. Illustratively, the actuator or actuators may include a threaded shaft 76, 77 and the threaded shafts may extend into a threaded passage 78 at a suitable location on the primary frame 52. The threaded shaft or shafts may be rotated by a secondary motor 80 that turns one shaft, or both shafts at substantially the same rotational speed, such as through driver pulleys 81, 82 and driven pulleys 83, 84, using belts 86, 87.

The system 10 may also include a main support frame 90 configured to support various elements of the system with respect to the sheet material 2 and support structure 3 which may be supported on the support bed 8. The main support frame 90 may extend over the support bed and may support at least one fastener movement apparatus 12 respect to the support bed. The one or more fastener movement apparatus 12 may be fixed in position with respect to the support bed, or may be movably mounted on the main support frame 90 to move with respect to the bed 8. Illustratively, one or more of the apparatus 12 may be movable in a second lateral direction generally transverse to the first longitudinal movement direction 9. The main support frame 90 may support a plurality of the fastener movement apparatus 12, and multiple assemblies 12 may be arranged in at least one array 92. In some embodiments, an array may include multiple primary movement assemblies and a single secondary movement assembly moving the primary assemblies (see FIG. 5). For example, six primary assemblies 40 may be moved by a single secondary assembly. A single shaft 58 may have mounted thereon a cam member for each of the primary movement assemblies of the array, and the cam member for each primary assembly in the array may be rotated out of sync with respect to the cam members of other primary assemblies such that an impulsive force is being imparted to only one fastener at a time by the array, although substantially simultaneous impacts by the assemblies 40 of the array could be utilized.

Arrays of the assemblies 12 may be positioned substantially along a line in a linear arrangement which may be useful for alignment of the array of assemblies with a (straight) board of the underlying support structure. The line of a first array 92 may extend in the second lateral direction (see FIG. 6), and may be movable in the longitudinal movement direction, and a second array 94 of assemblies 12 may extend in the longitudinal direction and may be movable in the lateral direction. The assemblies (or arrays of assemblies) may be movable on rails 95 mounted on the support frame, and support wheels 93 mounted on the assemblies may ride on the support rails.

Each of the fastener movement apparatus 12 may have an associated fastener loading assembly 96 configured to load fasteners into the driving position of the apparatus 12 for driving into the work piece. Suitable fastener loading apparatus are known to those skilled in the art of fastener driving machinery, and may be utilized in the system 10. The fastener supply mechanism 98 may include a fastener load solenoid 97 configured to move or eject a fastener into the driving position. A fastener supply mechanism 98 may be configured to hold a plurality of fasteners for supplying the fasteners to the fastener loading assembly 96.

The fastener movement apparatus 12 may also include a lift solenoid 100 configured to return the primary movement assembly 40 to the home position of the assembly.

A control assembly 104 may be provided for controlling various aspects or elements of at least one fastener movement apparatus 12. The control apparatus 104 may include controllers and sensors for operating the assembly 12. The control assembly may include a position sensor 106 for sensing a position of the fastener in the driving position, and may provide an indication of the degree to which the fastener has been driven into the work piece. In some implementations, a pair of position sensors may be utilized in a redundant manner for the purpose of detecting the occurrence of a malfunction in one of the position sensors, as well as providing a backup to a failed position sensor should failure of one of the sensors occur. The position sensor or sensors may generate a position signal indicative of the relative position of the fastener. The control assembly 104 may also include a fastener sensor 108 for sensing the presence of a fastener in the fastener supply mechanism 98 to provide an indication of whether the supply of fasteners has been exhausted and needs to be replenished. The fastener sensor 108 may generate a fastener present signal.

The control assembly 104 may also include at least one controller which may be in communication with the sensor or sensors and the movement assemblies, and may be configured to control operation of the motor 60 of the primary movement assembly and the motor 80 of the secondary movement assembly. The control assembly 104 may include a nose controller 110 in communication with at least one of the fastener load solenoids 97 to cause the fastener load solenoid to move a fastener from the supply to the driving position. The nose controller 110 may be in communication with the fastener sensor 108 to receive the fastener present signal. The control assembly 104 may also include a stroke controller 112 which may be in communication with the motor 80 of the secondary movement assembly to cause the motor 80 to operate the secondary movement assembly. The stroke controller 112 may be configured to control a speed of rotation of the motor 80 of the secondary movement assembly, and may be in communication with the position sensor 106 to receive the position signal.

It should be appreciated that in the foregoing description and appended claims, that the terms "substantially" and "approximately," when used to modify another term, mean "for the most part" or "being largely but not wholly or completely that which is specified" by the modified term.

It should also be appreciated from the foregoing description that, except when mutually exclusive, the features of the various embodiments described herein may be combined with features of other embodiments as desired while remaining within the intended scope of the disclosure.

Further, those skilled in the art will appreciate that the steps disclosed in the text and/or the drawing figures may be altered in a variety of ways. For example, the order of the steps may be rearranged, substeps may be performed in parallel, shown steps may be omitted, or other steps may be included, etc.

With respect to the above description then, it is to be realized that the optimum dimensional relationships for the parts of the disclosed embodiments and implementations, to include variations in size, materials, shape, form, function and manner of operation, assembly and use, are deemed readily apparent and obvious to one skilled in the art in light of the foregoing disclosure, and all equivalent relationships to those illustrated in the drawings and described in the specification are intended to be encompassed by the present disclosure.

Therefore, the foregoing is considered as illustrative only of the principles of the disclosure. Further, since numerous modifications and changes will readily occur to those skilled in the art, it is not desired to limit the disclosed subject matter to the exact construction and operation shown and described, and accordingly, all suitable modifications and equivalents may be resorted to that fall within the scope of the claims.

We claim:

1. A system for moving at least one fastener along a movement axis into a sheet material and into a support structure resting on a support bed to fasten the sheet material to the support structure, the sheet material having a face defining a face plane, the system comprising:

a main support frame with at least a portion of the main support frame extending over the support bed;

at least one fastener movement apparatus movably mounted on the main support frame, the at least one fastener movement apparatus comprising:

a guide frame defining a channel extending along the movement axis;

a contact member movable with respect to the guide frame along the movement axis, the contact member being at least partially positionable in the channel of the guide frame, the contact member having a contact tip for contacting the head of a fastener in a driving position;

a guide tube configured to hold a fastener to be moved and extending along the movement axis, the guide tube having a passage for receiving the fastener;

a primary movement assembly configured to transmit an impulse to a head of the fastener through the contact member;

a secondary movement assembly configured to move the primary movement assembly in a direction substantially parallel to the movement axis; and a control assembly configured to control the primary movement assembly and secondary movement assembly of the at least one fastener movement apparatus;

wherein the primary movement assembly comprises:

an impact member configured to impact the contact member;

a connector member connected to the impact member;

a primary frame located above the guide frame, the connector member being movable in the first frame;

a rotatable cam member configured to act on the connector member, the cam member having a perimeter edge with a lobe; and a shaft on which the cam member is mounted to rotate the cam member.

2. The system of claim 1 wherein the secondary movement assembly is configured to advance the primary movement assembly in discrete steps.

3. The system of claim 2 wherein each of the discrete steps advances the primary movement assembly a substantially uniform movement distance.

4. The system of claim 1 wherein the sheet material moves relative to the system in a first longitudinal movement direction, and the at least one fastener movement apparatus is movable in a second lateral movement direction transverse to the first longitudinal movement direction.

5. The system of claim 1 wherein the primary movement assembly further comprises:

a motor; and a primary movement transfer structure configured to transfer movement between the motor and the shaft.

6. The system of claim 1 wherein the secondary movement assembly comprises:

a secondary frame on which the primary movement assembly is mounted; the secondary frame being mounted on the main support frame; and at least one actuator mounted on the secondary frame and engaging the primary frame to move the primary frame with respect to the secondary frame.

7. The system of claim 6 wherein the at least one actuator comprises a threaded shaft, the threaded shaft extending into a threaded passage of the primary frame.

8. The system of claim 1 wherein each of the fastener movement apparatus further comprising:

a fastener loading assembly configured to load fasteners into the channel of the guide frame; and a fastener supply mechanism configured to hold a plurality of fasteners for the fastener loading assembly.

9. The system of claim 1 wherein the control apparatus includes:

at least one sensor; and at least one controller in communication with the at least one sensor and at least one of the movement assemblies.

10. The system of claim 9 wherein the at least one sensor includes a position sensor for sensing a position of the fastener in the driving position, the position sensor generating a position signal.

11. The system of claim 9 wherein the at least one sensor includes a fastener sensor for sensing the presence of at least one fastener in the fastener supply mechanism, the fastener sensor generating a fastener present signal.

12. A system for moving at least one fastener along a movement axis into a sheet material and into a support structure resting on a support bed to fasten the sheet material to the support structure, the sheet material having a face defining a face plane, the system comprising:

a main support frame with at least a portion of the main support frame extending over the support bed;

at least one fastener movement apparatus movably mounted on the main support frame, the at least one fastener movement apparatus comprising:

a guide frame defining a channel extending along the movement axis;

a contact member movable with respect to the guide frame along the movement axis, the contact member being at least partially positionable in the channel of the guide frame, the contact member having a contact tip for contacting the head of a fastener in a driving position;

a guide tube configured to hold a fastener to be moved and extending along the movement axis, the guide tube having a passage for receiving the fastener;

a primary movement assembly configured to transmit an impulse to a head of the fastener through the contact member;

a secondary movement assembly configured to move the primary movement assembly in a direction substantially parallel to the movement axis; and a control assembly configured to control the primary movement assembly and secondary movement assembly of the at least one fastener movement apparatus;

wherein the control apparatus includes:

at least one sensor; and at least one controller in communication with the at least one sensor and at least one of the movement assemblies;

wherein the at least one sensor includes a fastener sensor for sensing the presence of at least one fastener in the fastener supply mechanism, the fastener sensor generating a fastener present signal;

wherein the at least one controller comprises a nose controller in communication with at least one fastener load solenoid to cause the fastener load solenoid to move a fastener to the driving position, the nose controller being in communication with the fastener sensor to receive the fastener present signal.

13. The system of claim 12 wherein the primary movement assembly comprises:

an impact member configured to impact the contact member;

a connector member connected to the impact member;

a primary frame located above the guide frame, the connector member being movable in the first frame;

a rotatable cam member configured to act on the connector member, the cam member having a perimeter edge with a lobe; and a shaft on which the cam member is mounted to rotate the cam member.

14. A system for moving at least one fastener along a movement axis into a sheet material and into a support structure resting on a support bed to fasten the sheet material to the support structure, the sheet material having a face defining a face plane, the system comprising:

a main support frame with at least a portion of the main support frame extending over the support bed;

at least one fastener movement apparatus movably mounted on the main support frame, the at least one fastener movement apparatus comprising:

a guide frame defining a channel extending along the movement axis;

a contact member movable with respect to the guide frame along the movement axis, the contact member being at least partially positionable in the channel of the guide frame, the contact member having a contact tip for contacting the head of a fastener in a driving position;

a guide tube configured to hold a fastener to be moved and extending along the movement axis, the guide tube having a passage for receiving the fastener;

a primary movement assembly configured to transmit an impulse to a head of the fastener through the contact member;

a secondary movement assembly configured to move the primary movement assembly in a direction substantially parallel to the movement axis; and a control assembly configured to control the primary movement assembly and secondary movement assembly of the at least one fastener movement apparatus;

wherein the control apparatus includes:

at least one sensor; and at least one controller in communication with the at least one sensor and at least one of the movement assemblies;

wherein the at least one controller comprises a stroke controller in communication with a motor of the secondary movement assembly to cause the motor to operate the secondary movement assembly, the stroke controller being configured to control a speed of rotation of the motor of the secondary movement assembly.

15. The system of claim 14 wherein the primary movement assembly comprises:

an impact member configured to impact the contact member;

a connector member connected to the impact member;

a primary frame located above the guide frame, the connector member being movable in the first frame;

a rotatable cam member configured to act on the connector member, the cam member having a perimeter edge with a lobe; and a shaft on which the cam member is mounted to rotate the cam member.

* * * * *